US006152094A

United States Patent [19]

Kirschbaum

[11] Patent Number: 6,152,094

[45] Date of Patent: Nov. 28, 2000

[54] METHOD FOR DRIVING AN ELECTROMAGNETIC ACTUATOR FOR OPERATING A GAS CHANGE VALVE

[75] Inventor: Frank Kirschbaum, Stuttgart, Germany

[73] Assignee: DaimlerChrysler AG, Stuttgart, Germany

[21] Appl. No.: 09/394,482

[22] Filed: Sep. 11, 1999

[30] Foreign Application Priority Data

Sep. 19, 1998 [DE] Germany ..... 198 43 073

[51] Int. Cl.[7] ..... F01L 9/04

[52] U.S. Cl. ..... 123/90.11; 251/129.04; 251/129.1; 335/220

[58] Field of Search ..... 123/90.11; 251/129.01, 251/129.02, 129.05, 129.09, 129.1, 129.15, 129.16, 129.04; 335/220

[56] References Cited

U.S. PATENT DOCUMENTS

| | | | |
|---|---|---|---|
| 4,883,025 | 11/1989 | Richeson, Jr. | 123/90.11 |
| 5,004,079 | 4/1991 | Ivers et al. | 188/282 |
| 5,797,360 | 8/1998 | Pischinger et al. | 123/90.11 |
| 6,076,490 | 6/2000 | Esch et al. | 123/90.11 |

FOREIGN PATENT DOCUMENTS

| | | |
|---|---|---|
| 0 717 172 A1 | 6/1996 | European Pat. Off. . |
| 0 916 815 A2 | 5/1999 | European Pat. Off. . |
| 197 35 375 C | 7/1998 | Germany . |

*Primary Examiner*—Thomas Denion
*Assistant Examiner*—Patrick Cavaliere
*Attorney, Agent, or Firm*—Mark P. Calcaterra

[57] ABSTRACT

An electromagnetic actuator for the operation of a gas change valve has two electromagnets placed opposite to one another and an armature acting on the gas change valve that can be moved against the force of at least one valve spring. In an actuator of this kind, fluctuations of operational system parameters can lead to incorrect functioning and to increased wear of the actuator. With a new method for driving an actuator, the acceleration curve of the gas change valve is measured with an acceleration sensor and the energy supplied to the electromagnet capturing the armature is controlled according to the acceleration curve of the gas change valve. In this way, kinetic energy losses due to disturbances can be compensated so that the armature impacts the capturing electromagnet with a predetermined velocity.

6 Claims, 2 Drawing Sheets a
t v
t x
t $t_0$
$t_1$
$t_2$

METHOD FOR DRIVING AN ELECTROMAGNETIC ACTUATOR FOR OPERATING A GAS CHANGE VALVE

BACKGROUND OF THE INVENTION

The invention relates to a method for electromagnetic valve actuation. More specifically, the invention pertains to gas change valve actuation in an internal combustion engine.

EP 0 71 7 1 72 A1. Discloses a gas change valve of an internal combustion engine is operated by means of an electromagnetic actuator. This has two electromagnets placed opposite to one another and between which an armature that acts on the gas change valve is moved to and fro by energizing the electromagnets alternately. The actuator is driven in accordance with the momentary position of the gas change valve as determined by a position sensor such that the gas change valve does not come into contact with a piston of the internal combustion engine.

It has been found to be disadvantageous here that disturbances, especially fluctuations of operational system parameters such as the friction, the temperature and the pressure in the combustion chambers of the internal combustion engine, as well as changes in the viscosity of the lubricant and dirtying of the actuator or gas change valve, can lead to incorrect functioning of the actuator and to increased wear of the actuator. There is therefore no guarantee that the actuator will operate reliably over a lengthy period of time.

SUMMARY OF THE INVENTION

An object of the invention is to provide a valve actuator exhibiting long life of the actuator and of the gas change valve together with reliability in continuous use.

In accordance with the invention, the gas change valve acceleration curve can be measured by means of an acceleration sensor (which can be fitted to the gas change valve or to a part of the actuator moved with the gas change valve, for example the armature) and the energy supplied to the electromagnet capturing the armature is controlled as a function of this acceleration curve.

The method according to the invention has the following advantages:

The acceleration curve of the gas change valve is a measure of the force acting on the armature and on the gas change valve and can therefore best be used for controlling the dynamic response of the armature and the gas change valve.

From the acceleration curve of the gas change valve, the velocity and the position of the gas change valve can be determined in a simple way by integrating once and twice respectively with respect to time, and this can be used to automatically control the velocity with which the armature impacts the electromagnet capturing it or of the gas change valve in a valve seat. Owing to the filtering action achieved by the integration, any noise components overlaying the values of the acceleration curve are at the same time suppressed.

By integration of the acceleration curve with respect to the path over which the gas change valve is moved, or with respect to time, one obtains a controlled variable that varies according to disturbance variables and from which the energy required by the actuator for compensation of the disturbance variables can be determined. Disturbance-free operation is thus ensured even when the disturbance varies during operation, especially energy losses due to friction or mechanical work that must be compensated for in opposition to an internal pressure in the combustion zone at the time of opening the gas change valve in the combustion chamber of an internal combustion engine.

By automatically controlling the impact velocity of the armature on the respective electromagnet capturing it, the wear in the actuator is minimized along with the resulting noise development. At the same time, the energy consumption of the actuator is minimized because only that amount of energy necessary for safe operation is supplied to the respective electromagnet.

DESCRIPTION OF THE PREFERRED EMBODIMENTS

The invention will now be described in more detail on the basis of an embodiment example with reference to the Figures.

Figure 1:
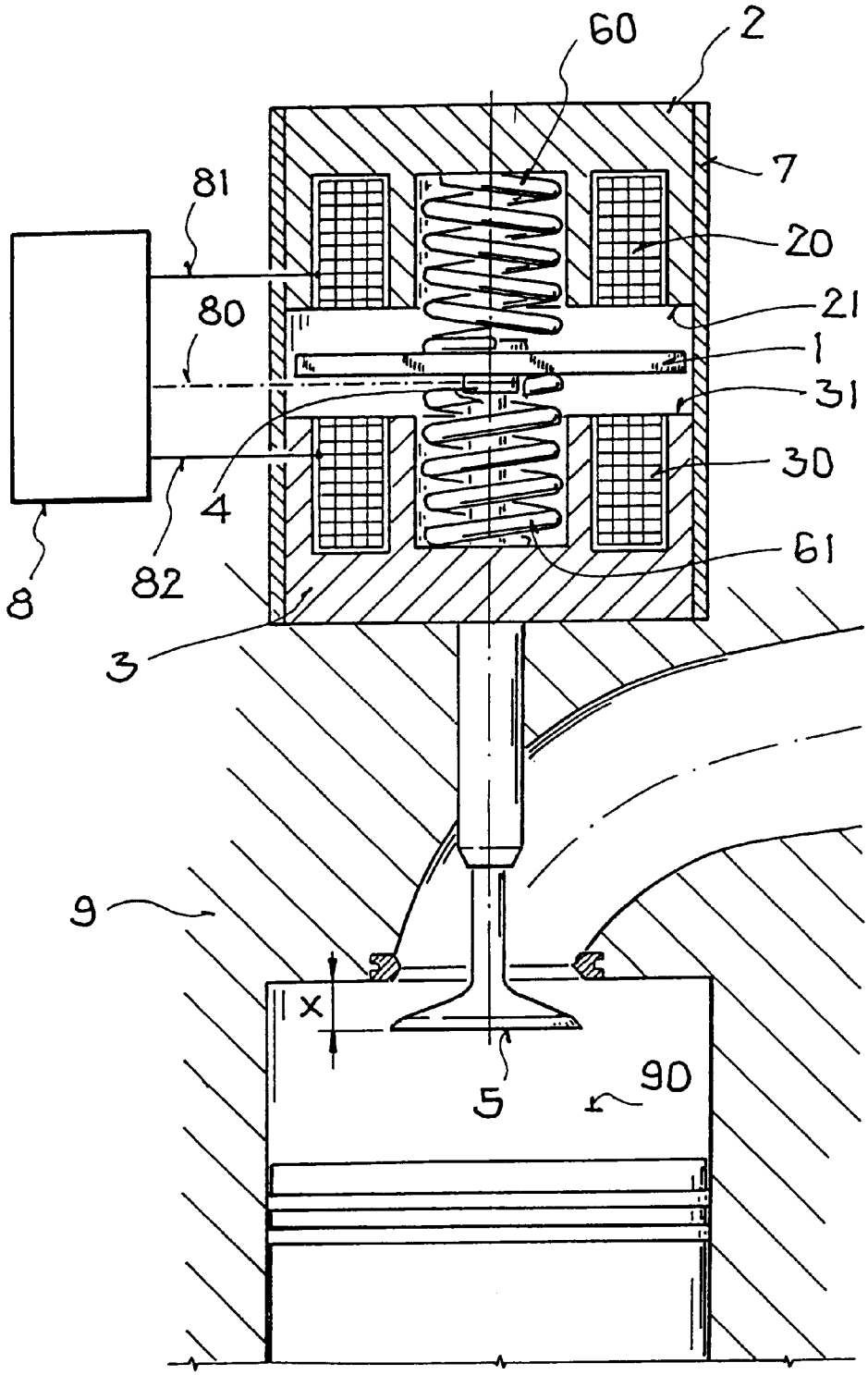
FIG. 1*a* is a view of a gas change valve operated by an electromagnetic actuator with a control unit for driving the actuator.

As shown in FIG. 1, the actuator comprises an armature 1 which interacts with a plunger of a gas change valve 5 that moves together with armature 1, an electromagnet 2 that acts as a closing magnet, and another electromagnet 3 that acts as an opening magnet which is arranged at a distance from closing magnet 2 in the direction of the plunger longitudinal axis. The electromagnets 2, 3 are joined together by means of a housing part 7 and attached to a cylinder head part that covers the combustion chamber 90 of an internal combustion engine 9; each of the two electromagnets has an operating coil 20 and 30 respectively and pole surfaces 21 and 31 respectively opposing each other between which the armature 1 is moved to and fro by alternately energizing the two electromagnets 2, 3, i.e. by supplying current to the operating coils 20 and 30 respectively. Two oppositely acting valve springs 60, 61 cause the armature 1 to be held in a position of equilibrium approximately in the middle between the pole surfaces 21, 31 of the electromagnets 2, 3 when no current is flowing through the operating coils 20, 30. The electromagnets 2, 3 are driven through control lines 81, 82 by a control unit 8 which is also connected through a signal line 80 indicated by a dash-dotted line to an acceleration sensor 4 from which it receives information on the variation of the acceleration of the gas change valve 5 in the form of measured values. The control unit 8 comprises a conditioning unit for processing the measured values, a final controlling element on the output side of the conditioning unit for generating manipulated variables, and an output stage for driving the electromagnets 2, 3 in accordance with the manipulated variables. The control unit 8 and the acceleration sensor 4, which in the present embodiment example is attached to the gas change valve 5 but which can also be attached to any other part of the actuator moved with the gas change valve 5, for example to the armature 1, together form a control loop for automatically controlling the impact velocity of the armature 1 on the capturing electromagnet 2 or 3 respectively.

To start the actuator, one of the electromagnets 2, 3 is energized by applying an excitation voltage to the corresponding operating coil 20 or 30 respectively, i.e. it is switched on, or a build-up routine is initiated through which the armature 1 is initially put into a state of oscillation by alternately energizing the electromagnets 2, 3 in order to make contact with the pole surface 21 of the closing magnet 2 or the pole surface 31 of the opening magnet 3 after a transient period.

Figures 2A, 2B, 2C:
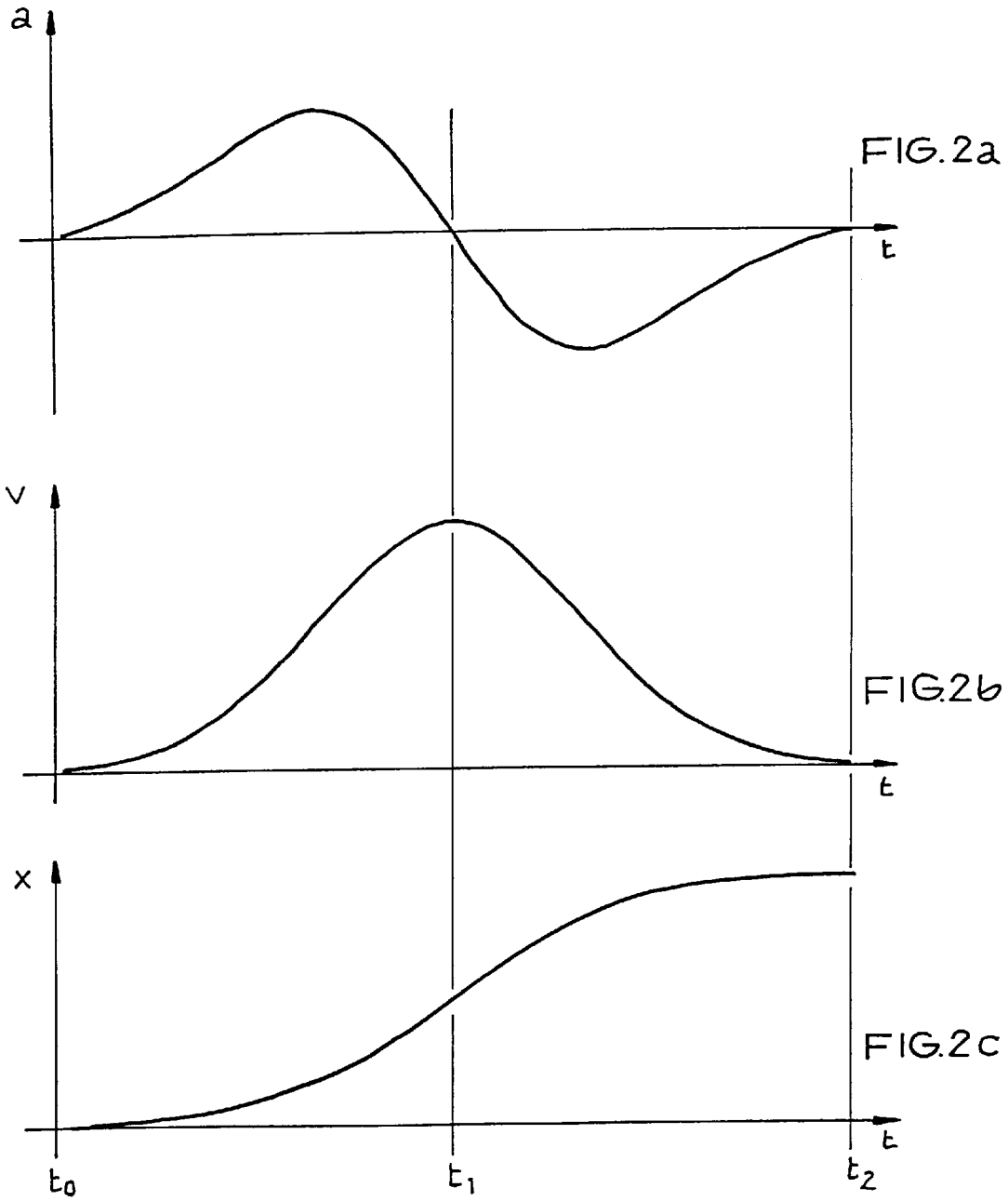
FIG. 2*a* is a view of a diagram showing the variation against time of the acceleration (FIG. 2*a*), the velocity (FIG. 2*b*) and the position (FIG. 2*c*) of the gas change valve for undisturbed operation.

When the gas change valve 5 is closed, the armature 1 is in contact with the pole surface 21 of the closing magnet 2 and it is held in this position as long as the closing magnet 2 is energized. In order to open the gas change valve 5, the closing magnet 2 is switched off and then the opening magnet 3 is switched on. According to FIG. 2*a*, which shows the variation of the acceleration a of the gas change valve 5 against the time t and hence the variation of the forces acting on the armature 1 and the gas change valve 5, this takes place at time $t_o$. The gas change valve 5 is then accelerated to a maximum value by the valve spring 60 that relaxes in the opening direction and then drops down to the value 0 at time $t_1$. At this point of time, the gas change valve 5 is in its position of equilibrium in which the spring forces of the valve springs 60, 61 acting on armature 1 are of equal magnitude and where the velocity v of the gas change valve 5 reaches its maximum value, as shown in FIG. 2*b*. Because of its high kinetic energy, the gas change valve 5 is accelerated beyond the position of equilibrium but is decelerated by the valve spring 61 that acts in the closing direction, so that the armature 1 impacts the pole surface 31 of the opening magnet 3 at time $t_2$ with a lower velocity v and is held there until the opening magnet 3 is switched off. Due to the energization of the opening magnet 3 that captures armature 1, sufficient kinetic energy is transferred to the armature 1 during its motion that it reaches the pole surface 31 of the opening magnet 3 in spite of any frictional losses.

To again close the gas change valve 5, the opening magnet 3 is switched off and the closing magnet 2 is then switched on again. This causes the armature 1 to move towards the pole surface 21 of the closing magnet 2 and it is held there.

In order to prevent the armature 1 from impacting the pole surface 21 or the pole surface 31 with too high a velocity or not even reaching it in the event of a change in the operating parameters (in particular when disturbance variables occur or fluctuate, such as, for example, energy losses due to friction or mechanical work that must be performed to counteract a combustion chamber internal pressure in the combustion chamber 90 at time $t_0$ of opening the gas change valve 5) it is necessary to automatically control the supply of energy to the relevant electromagnet 2 or 3 capturing the armature 1. This is accomplished by the acceleration curve a of the gas change valve 5 being measured by the acceleration sensor 4 and by the energy supply to the electromagnet 2 or 3 capturing the armature 1 being controlled by the control unit 8 in accordance with the acceleration curve a, where the latter depends on time t.

For this purpose, in a first development of the method according to the invention, the variation of the velocity v of the gas change valve 5 against time as shown in FIG. 2*b* is determined in the control unit 8 from the acceleration curve a by integrating with respect to time t, the variation of the position x of the gas change valve 5 against time t as shown in FIG. 2*c* is determined from the velocity curve v by integrating again with respect to time t and from this the acceleration curve a is defined as a function of position x. From this curve of acceleration a against position x, a controlled variable is formed by integration over the path travelled by the gas change valve 5 (i.e. over position x) having a curve that varies according to the position x and which is proportional to the kinetic energy of the gas change valve 5. By controlling the energy supply to the electromagnet 2 or 3 capturing the armature 1, this controlled variable is regulated to a setpoint value that is specified by a predefined setpoint characteristic which is dependent on the position x of the gas change valve 5, i.e. the curve of the controlled variable is corrected according to the curve of the setpoint characteristic. The controlled variable is compared here with the setpoint value and the relevant electromagnet 2 or 3 is driven according to the difference between the controlled variable and the setpoint value. The setpoint characteristic here represents the characteristic that one obtains for the curve of the controlled variable when the armature 1 impacts with a predetermined velocity v of approximately 0.3 m/s the electromagnet 2 or 3 capturing it and when no disturbances act on the armature 1 or the gas change valve 5. The difference between the controlled variable and the setpoint value is therefore a measure of the loss of kinetic energy caused by disturbance variables, so that by automatically controlling the controlled variable sufficient kinetic energy is supplied to the armature 1 to compensate for this loss of kinetic energy, i.e. the armature 1 receives from the energized electromagnet 2 or 3 respectively sufficient kinetic energy to ensure that it is captured by it but does not impact its pole surface 21 or 31 respectively with a velocity v exceeding the predetermined velocity.

In a further development of the method according to the invention, the controlled variable is generated in the control unit 8 by integrating the curve of the acceleration a of the gas change valve 5 over time t. The curve of the controlled variable is therefore a function of time t and, as in the case of the first development of the method according to the invention, is corrected according to a predetermined setpoint characteristic, which now is dependent on time, that, as in the case above, represents the characteristic that one obtains for the curve of the controlled variable when the armature 1, with the predetermined velocity v, impacts the electromagnet 2 or 3 capturing it and no disturbances act on the armature 1 or on the gas change valve 5. Also through this manner of automatically controlling the controlled variable, it is ensured that sufficient energy is supplied to the electromagnet 2 or 3 capturing the armature 1 that the armature 1 is reliably captured by the respective electromagnet 2 or 3 and does not impact it with too high a velocity v.

What is claimed is:

1. Method for driving an electromagnetic actuator for operating a gas change valve, the actuator including first and second electromagnets positioned on opposite sides of an armature coupled to the gas change valve, the first and second electromagnets operative to move the armature against a force of at least one valve spring, the method comprising the steps of:

a) measuring by means of an acceleration sensor an acceleration curve of the gas change valve; and b) controlling an energy supply to the first and second electromagnets as a predetermined function of the acceleration curve.

2. Method in accordance with claim 1 wherein a position of the gas change valve is determined from the acceleration curve of the gas change valve wherein a controlled variable is formed by integration of the acceleration curve of the gas change valve over a path travelled by the gas change valve, and wherein a curve of the controlled variable is corrected according to a predefined setpoint characteristic by controlling the supply of energy to the electromagnet capturing the armature.

3. Method in accordance with claim 2, wherein the setpoint characteristic is predefined in such a way that the armature impacts the capturing electromagnet with a predetermined velocity when the curve of the controlled variable follows the setpoint characteristic.

4. Method in accordance with claim 1, wherein a controlled variable that is a function of time is formed by integration of the acceleration curve of the gas change valve over time and wherein the curve of the controlled variable is corrected according to a predefined setpoint characteristic by controlling the supply of energy to the electromagnet capturing the armature.

5. Method in accordance with claim 4, wherein the setpoint characteristic is predefined in such a way that the armature impacts the capturing electromagnet with a predetermined velocity when the curve of the controlled variable follows the setpoint characteristic.

6. Method in accordance with claim 1, wherein the method is used for the operation of gas change valves in internal combustion engines.

* * * * *